US007066852B1

(12) United States Patent
Feeney et al.

(10) Patent No.: US 7,066,852 B1
(45) Date of Patent: Jun. 27, 2006

(54) GAME BALL WITH IMPROVED MOISTURE RESISTANCE

(75) Inventors: Brian Feeney, Enfield, CT (US); Chris Waldeck, Westfield, MA (US)

(73) Assignee: Callaway Golf Company, Carlsbad, CA (US)

( * ) Notice: Subject to any disclaimer, the term of this patent is extended or adjusted under 35 U.S.C. 154(b) by 0 days.

(21) Appl. No.: 09/248,595

(22) Filed: Feb. 11, 1999

Related U.S. Application Data

(63) Continuation-in-part of application No. 09/184,369, filed on Nov. 2, 1998.

(51) Int. Cl.
*A63B 41/08* (2006.01)
*A63B 37/00* (2006.01)

(52) U.S. Cl. ..... 473/599; 473/601

(58) Field of Classification Search ..... 473/FOR. 124, 473/569, 598–610, 52; 273/225; 428/220
See application file for complete search history.

(56) References Cited

U.S. PATENT DOCUMENTS 72,772 A * 12/1867 Alden ..... 473/603
1,021,424 A * 1/1962 Osborne ..... 273/225
3,069,170 A 12/1962 Dillon, Jr.
3,887,416 A * 6/1975 Tebbetts, Jr. ..... 473/599
4,154,789 A * 5/1979 Delacoste ..... 264/138
4,462,589 A 7/1984 Morgan
4,498,667 A * 2/1985 Tomar ..... 473/600
4,755,187 A 7/1988 Friese et al. ..... 8/94.23
4,880,233 A 11/1989 Song
4,991,840 A * 2/1991 Patton ..... 473/426
5,069,935 A * 12/1991 Walters ..... 473/599
5,181,717 A * 1/1993 Donntag et al. ..... 473/603
5,204,088 A 4/1993 Noebel et al. ..... 424/47
5,294,112 A 3/1994 Smith
5,342,043 A * 8/1994 Baltronis et al. ..... 473/599
5,480,144 A * 1/1996 Downing ..... 473/599
5,669,838 A * 9/1997 Kennedy et al. ..... 473/599
5,820,488 A * 10/1998 Sullivan et al. ..... 473/378
5,875,891 A 3/1999 Snell

* cited by examiner

*Primary Examiner*—Mitra Aryanpour
(74) *Attorney, Agent, or Firm*—Michael A. Catania; Elaine H. Lo

(57) ABSTRACT

A game ball having improved resistance to liquid moisture, wherein the game ball includes a water resistant lining and a leather cover with water resistance properties. The water resistance properties of the cover are imparted by the tanning process and the lining is coated with a water resistant polymeric material.

1 Claim, 2 Drawing Sheets

GAME BALL WITH IMPROVED MOISTURE RESISTANCE

RELATED APPLICATION

This application is a continuation in part of pending U.S. patent application Ser. No. 09/184,369, filed Nov. 2, 1998 and entitled "GAME BALL WITH IMPROVED MOISTURE RESISTANCE".

FIELD OF THE INVENTION

The present invention relates generally to game balls with improved moisture resistance. In particular, the invention relates to game balls with leather covers which provide moisture resistance through prolonged or repeated exposure to liquid moisture.

BACKGROUND OF THE INVENTION

Game balls are commonly exposed to moisture in the liquid state during the course of normal use. For example, a game ball may commonly come in contact with the perspiration of a player as the ball is handled and with dew, rain, and snow on the playing surface and surrounding area. It is even possible for a ball to become immersed in a puddle or other body of water during the course of normal play.

When a traditionally made leather covered game ball comes in contact with water, an amount of water is likely to be absorbed by the leather cover. Direct and obvious negative effects which result from the cover absorbing water include an increase in the weight of the ball, a deterioration in ball handling characteristics and a darkening of the color of the leather cover. It will be appreciated that the weight and handling characteristics of the ball are of particular importance at any level of athletic play, and that preserving the original dry handling characteristics of a ball even in adverse weather or poor field conditions is of great importance.

It is well known that leather softens when wet and becomes noticeably less durable. In particular, wet leather is less resistant to wear from surface abrasion, cuts and gouges from contact with coarse or sharp objects. As leather dries, it typically shrinks and becomes harder and stiffer than prior to wetting. In a game ball, this may lead to cracking of the leather, or even tearing in areas of high stress, such as at stitching points between the cover panels of the ball. Repeated cycles of wetting and drying can exacerbate the problem of shrinkage, cracking and hardening of the leather cover. Therefore, it will be recognized by the practitioner that the overall durability of a ball and its resistance to absorbing moisture in the liquid state are of particular importance in prolonging the useful life and preserving the structure and playability of the ball.

Various materials are known in the art for providing protection against wetting of the leather cover of a game ball. These materials are primarily intended for treating the outer surface of the cover in order to impart a water repellant finish. Waxes and wax-like substances such as SIMONZ wax, commercially available from S.C. Johnson Wax Company, Racine, Wis., and a specialty waterproofing wax-like material known as SNO-SEAL commercially available from ATSKO/Sno-Seal, Inc., Orangeburg, S.C., have been applied to leather game ball covers to impart a water repellant finish. Other materials, such as the polyfluoroalkyl materials disclosed in U.S. Pat. No. 5,069,935 and the silicone materials disclosed in U.S. Pat. No. 5,204,088 have also been used on game ball covers.

All of the wax and wax-like substances, polyfluoroalkyl materials and silicone materials tend to wear away during the course of normal game ball use. Thus, the effectiveness of the water resistance these materials may provide may be greatly diminished or even totally lost. In addition, some materials, such as the silicone-based materials for imparting water resistance, may even wash off under wet playing conditions.

Further drawbacks of treating the game ball cover with these types of waterproofing materials include significantly altering the color of the leather to which the materials are applied. Typically, the leather is considerably darkened through the application of these materials. More importantly, leather covered game balls which have been treated with these materials have their "feel" significantly altered. For game play, maintaining the normal texture, feel and grip of the game ball is of significant importance. Applying materials which cause a ball to become slippery, sticky, or in the case of some waxes, simply unpleasant to handle, can significantly alter the normal course of play.

The leather tanning and hide industry has developed tanning techniques for improving the water resistance properties of leather. One such process is known as "fat liquoring". This process is disclosed in U.S. Pat. No. 4,755,187 and involves the use of a sulfosuccinic monoester in the tanning and treating chemicals to impart the desired water resistance properties to the finished hides.

SUMMARY OF THE INVENTION

An object of the present invention is to provide a game ball with a leather cover having improved resistance to liquid moisture.

Another object of the present invention is to provide a game ball which retains improved resistance to liquid moisture through repeated exposures to liquid moisture.

A further object of the present invention is to provide a game ball which retains resistance to liquid moisture through prolonged exposure to liquid moisture.

Other objects of the present invention will be in part obvious and in part pointed out in more detail hereinafter.

These and related objects are achieved in the present invention by providing a game ball which includes a lining having water resistant properties over which a leather cover is disposed having water resistant properties. Typically, balls featuring this type of construction include an air bladder. However, balls of other types of construction (including those made with central cores or centers) may also benefit from use of this invention.

The lining used in the ball of the present invention provides structure and reinforcement for the cover of the ball, as in a traditional ball lining. However, the lining also provides for improved water resistance in the finished ball.

The lining of the present invention includes one or more plies of fabric, scrim or even non-woven fibers which are coated with a water resistant polymeric material. The polymeric material is intended to coat and waterproof the fibers of the fabric or scrim or completely encapsulate the fabric or scrim, thereby forming a sheet-like structure of polymeric material with the fabric or scrim embedded within. When the material of the lining is covered with the polymeric material, absorption of water by the lining is kept to a minimum. In addition, the lining can be made from a monolithic sheet formed from a water resistant polymeric material.

The leather used in the cover of the ball is prepared by a tanning process and using tanning materials which impart the desired water resistance properties to the leather. The inventors have found that the water resistance properties imparted in the tanning process are longer lasting and provide better water resistance than surface treatments conventionally used on game balls. The water resistance properties imparted by the tanning process are distributed throughout the leather and are associated with each fiber of the leather and not simply on the outer surface of the leather. Because of the distribution of the water resistance properties throughout the leather, water which contacts the leather is typically unable to find an untreated area at which to be absorbed, including the stitching lines between panels, the panel edges and the back or split side of the leather cover. Furthermore, because the water resistance properties are distributed throughout the leather, the properties are not readily susceptible to wearing or washing away, as are the water resistance treatments applied to the surface of other conventional game balls.

The water resistant lining of the present invention avoids the problem of water absorption by the materials used in a conventional lining. In addition, the water resistant lining helps to prevent infiltration of water which may seep through the seams between the ball panels or other openings in the cover of the ball.

It is envisioned that any game ball can advantageously be constructed according to the present invention including, but not limited to, those game balls traditionally constructed with an outer cover and inner bladder, or optionally, those constructed with a lining disposed between the cover and bladder. Such game balls include, but are not limited to, American-style footballs, rugby balls, soccer balls, volleyballs, and basketballs. It is further envisioned that other leather covered balls may benefit from the present invention, including those balls which have a construction which traditionally features a cover and a core, such as baseballs and softballs.

DETAILED DESCRIPTION OF THE INVENTION

For clarity of description and ease of understanding, the invention will be described in connection with the structure shown in FIGS. 1 and 2 wherein like structures and like features in the Figures are identified with the same numbers. It will be noted that FIG. 2 relates to an American-style football, but other game balls with leather covers can advantageously employ the various features of the present invention.

Figure 1:
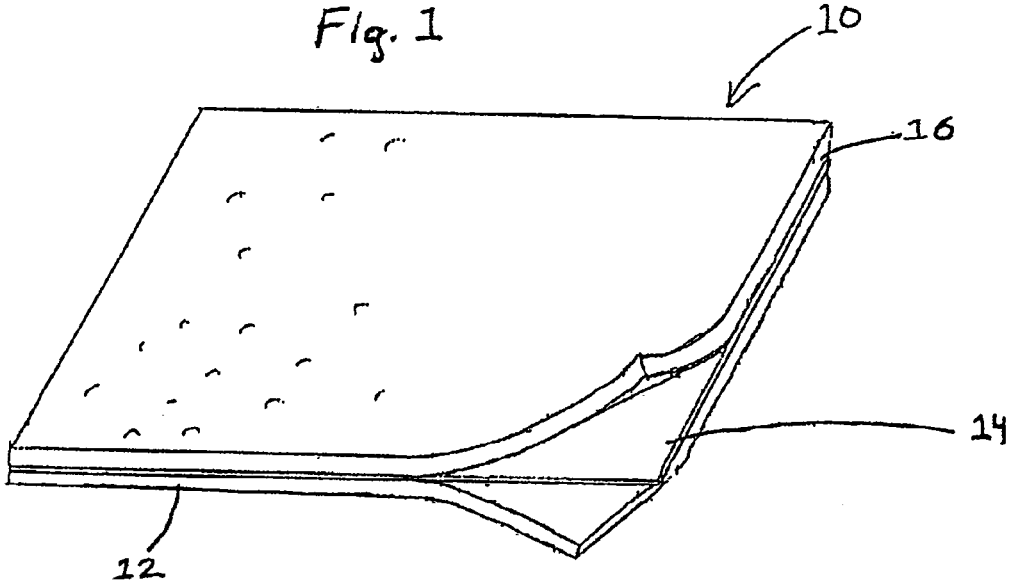
FIG. 1 is a magnified view, partially peeled away and partially sectional, of a portion of a game ball incorporating the features of the present invention.
Figure 2:
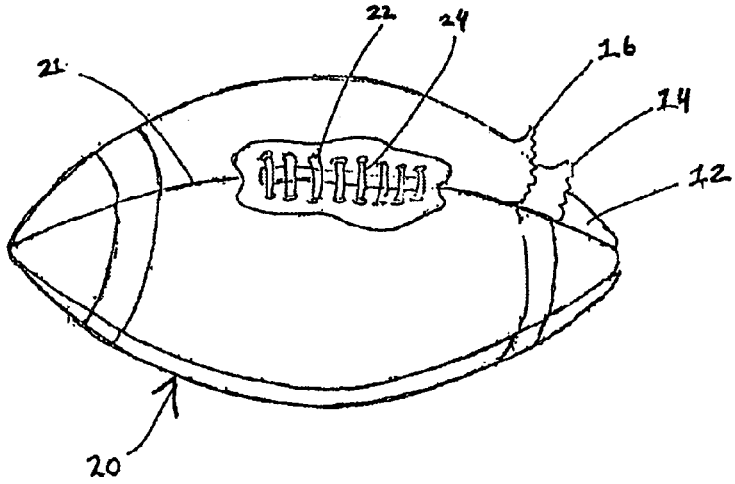
FIG. 2 is a plan view of an American-style football, partially peeled away, incorporating the features of the present invention.

FIG. 1 shows a magnified view of a portion of a game ball 10 made according to the present invention. The game ball 10 comprises an inner layer of air bladder material 12 which is commonly made of a highly durable, stretchable inflatable material such as butyl rubber or a polyurethane material. It will be understood that any material which possesses properties and performance qualities similar to butyl rubber or polyurethane may be used as the material of the air bladder. Disposed directly over the air bladder material 12 is the lining 14. The lining is employed in the structure of the game ball to help the ball retain the proper shape and to provide additional strength and mechanical reinforcement to the cover material 16. Significant amounts of stress and strain are imposed on the cover by the forces generated by the inflated bladder. In addition, further stress is applied to the ball through the normal action of kicking, bouncing and general rough handling that a ball receives while in play.

The lining used in the present invention helps improve the water resistance properties of the ball. Traditionally, the linings of game balls were formed from one or more plies of fabric or scrim made from highly water absorbent natural fibers such as cotton or linen. Synthetic fibers such as polyester, nylon and even glass fibers have more recently been used in forming the lining material. In the present invention, the lining is made from fabric, scrim or even non-woven fibers in a mat or other form of one or more plies which have been coated with a suitable water resistant polymeric material for resisting penetration and absorption of water in the liquid state. Such polymeric materials include vinyl, polyolefins, polyesters and urethanes, although it is fully within the scope of this invention to use other materials which are water resistant and have physical properties suitable for use in a ball. The polymeric material may be applied to the fibers of the lining in an amount ranging from an amount sufficient to coat the fibers in a water resistant jacket, or in an amount sufficient to fill the voids in the weave of the fabric or the open spaces in a scrim or a non-woven fiber lining. Essentially, with sufficiently high amounts of polymeric material, the fabric, scrim or non-woven fibers are embedded or completely encapsulated in a sheet of the polymeric material.

The lining may optionally be formed from a sheet-like material, such as a continuous monolithic sheet of a resin or other plastic material. Suitable materials for a sheet-like lining include vinyls, polyolefins, polyesters, and urethanes. The sheet-like material is preferably non-porous and may even include reinforcement fibers. Suitable fibers would include cotton, linen, polyester, polyolefin, nylon and glass fibers.

When the material of the lining takes the form of sheet-like material or, for example, a lining material completely encapsulated in a sheet of a polymeric material, additional benefits may be realized in the invention. A continuous barrier pressed tightly against the backside of the leather cover by the inflated air bladder forms a "gasket" which can seal the backside of the cover against infiltration by water. This is of particular importance in preventing or reducing absorption of water which may enter a ball, such as an American-style football 20 as in FIG. 2, through the seams 21, stitching holes, lacing holes 22 for lacings 24 or other openings commonly found in the cover of the ball. In these instances, the gasket effect would help to localize the infiltrating water at the point of entry.

The cover material 16 is formed of a leather which has been tanned by a process using chemicals for imparting water resistance properties to the finished leather. The leather used in the cover of the ball may be one of the type which is traditionally used for such a ball. For example, in an American-style football as shown in FIG. 2, the leather would traditionally be a cowhide leather. Similarly, a baseball would also traditionally have a cover made from cowhide leather. However, the actual leather used in the cover of a ball need not be of the traditional type for a particular variety of game ball. For the purposes of this invention, it is more important that the leather used possess the necessary performance properties, including sufficient resistance to water.

The leather used in the present invention is a tanned leather which has substantial water resistance properties imparted by the tanning process and the particular tanning chemicals used in the process. The tanning process imparts water resistance throughout the leather, with all the fibers of the leather acquiring water resistant properties. The tanned-in nature of the water resistance properties makes the leather less likely to absorb water than those leathers which have merely a topical water resistance treatment. The tanned-in water resistance is of particular importance when the ball receives prolonged or multiple exposures to wet conditions.

The water resistance properties of different leathers can be compared in terms of the amount of water absorbed over a period of time by a given size sample of leather. For the purposes of this application, water resistance is expressed as a ratio of the combined weight of a leather sample and the water absorbed after a specific period of immersion in water compared to the original dry weight of the leather sample. It will be appreciated that a sample of leather which has a low ratio, that is, a ratio approaching 1:1, has better water resistance than a sample with a higher ratio.

To achieve the goals of the present invention, the leather used in the game ball should have a ratio of the combined weight of the leather sample and the water absorbed after immersion in water for 45 minutes compared to the original dry weight of the leather sample in the range of 1.01:1 to 1.5:1. Preferably, the ratio should be in the range of 1.02:1 to 1.3:1, and most preferably, 1.05:1 to 1.2:1. Similarly, a football made according to the invention should have a ratio of 1.2:1 or less after 45 minutes of immersion in water.

Leather meeting the requirements of the present invention may be commercially obtained from a leather supplier such as Pittard's, Inc., Leeds, England or Bali Leathers, Inc., Johnston, N.Y. Specific examples of leathers having waterproofing or water resistance properties which meet the requirements of this invention are available from Pittard's, Inc. under the designations Pittard's WR2000TC and WR100 leather.

Leather tanned using the Pittard's process and chemicals results in a permanent tanned-in water resistance which permeates the leather and imparts water resistance properties to all the fibers of the leather. Leather which is treated in this way is highly resistant to water in the liquid form, but permits the passage of water vapor through the leather rather freely.

In this invention, the performance of the entire ball in the face of wet conditions is of particular importance. If a game ball of the present invention having a leather cover and a lining is subjected to the "rain test" (as described herein) for a period of 45 minutes, the ball would absorb a limited amount of water expressed as the "absorption ratio" of the weight of the ball plus absorbed water to the dry weight of the ball, that ratio would be in the range of 1.01:1 to 1.2:1. Preferably, the absorption ratio for the ball would be within the range of 1.01:1 to 1.15:1. Consequently, an American-style football made according to the present invention with an air bladder, a lining and a leather cover has water resistance properties sufficient to limit the absorption of water by the ball to an amount of 120 g or less of water when the ball is subjected to a cycle of the rain test of one hundred twenty minutes duration.

The ability of the water resistance of the ball of the present invention to remain after repeated wettings is also of particular importance. If the game ball of the present invention is exposed to six cycles of the rain test when each cycle has 45 minutes duration and the ball is allowed to dry at about 70° F. for 24 hours between cycles, the ball will maintain an absorption ratio in the range of 1.01:1 to 1.2:1. Preferably, the ball will maintain an absorption ratio in the range of 1.01:1 to 1.15:1. Consequently, an American-style football will absorb water in an amount of 120 g or less when the ball is subjected to six cycles of the rain test and wherein each cycle has one hundred twenty minutes duration and the ball is permitted to dry between cycles. Preferably, an American-style football will absorb water in an amount of 75 g or less when the ball is subjected to six cycles of the rain test and wherein each cycle has one hundred twenty minutes duration and the ball is permitted to dry between cycles.

Having generally described the invention, the following example is included for the purposes of illustration so that the invention may be more readily understood. The example is in no way intended to limit the scope of the invention unless otherwise specifically indicated.

EXAMPLE

An American-style football was constructed according to the present invention. The ball was formed using a butyl rubber air bladder over which a water resistant lining was formed. The lining was made from two plies of a polyester scrim cloth and was completely encapsulated in vinyl. The cover of the ball was made of Pittard's WR 100 leather. This ball was designated Example 1.

A comparative football was constructed using the Pittard's WR 100 leather as in the ball of Example 1. However, this ball does not have a water resistant lining. This ball is designated Comparative Example 1.

Two comparative Rawlings brand ST-5 balls were tested. The first ball, Rawlings ST-5 (A), was designated Comparative Example 2. The second ball, Rawlings ST-5 (B), was designated Comparative Example 3.

Two comparative Wilson brand NFL Game Balls were tested. The first ball, Wilson NFL Game Ball (A); was designated Comparative Example 4. The second ball, Wilson NFL Game Ball (B), was designated Comparative Example 5.

The footballs were tested for water resistance using the "rain test". The test consists of placing the ball on a support in an enclosed chamber wherein the support is formed from a set of vertically oriented pins which allow sprayed water access to the surface of the ball. An ordinary oscillating lawn sprinkler is placed in the chamber and located horizontally a distance of approximately two feet from the football. The sprinkler is aligned with the longitudinal axis of the football and the position of the sprinkler is adjusted so that the center of the arc through which the sprinkler spray bar travels is centered on the ball. The spray from the sprinkler travels in a generally horizontal direction in order to strike the ball being tested.

The sprinkler which was used in this series of tests has a spray bar which features fifteen spray apertures with each aperture spaced about 0.5 inches from the next aperture. Each aperture in the spray bar has a diameter of approximately 0.035 inches. The flow rate of the water used in the test was determined with the sprinkler removed from the connecting hose and the valve controlling the flow of water completely open. The flow rate of water through the connecting hose was determined to be approximately 12 gallons per minute.

Prior to the start of the test, each ball was weighed to determine its starting weight and the weights were recorded. Individually, the balls were set on the pins of the chamber, the chamber closed and the water valve supplying water to the sprinkler was opened completely, allowing the sprayed water to strike the surface of the ball. At scheduled intervals as shown in the tables below, the test ball was removed from the chamber, the water on the surface of the ball wiped off, and the ball weighed. Each of the balls was subjected to up to 120 minutes of testing time in the chamber. At the end of a testing "cycle", i.e., up to 120 minutes of testing time, the ball was removed from the chamber and allowed to dry for about 24 hours at about 70° F. At the start of the next test cycle the ball was weighed again, and the weight noted.

In the Tables 1(A), 2(A), 3(A), 4(A), 5(A) and 6(A), the increase in weight of the ball for each recording period is given in grams. In corresponding Tables 1(B), 2(B), 3(B), 4(B), 5(B) and 6(B), the ratio of the absorbed water and football to the initial weight of the football for each cycle is reported.

TABLE 1(A)

Example 1

| | Change in Ball Weight (in grams) | | | | | |
|---|---|---|---|---|---|---|
| Time | Cycle 1 | Cycle 2 | Cycle 3 | Cycle 4 | Cycle 5 | Cycle 6 |
| 0 | 0.0 | 3.5 | −0.2 | −1.5 | 1.1 | 0.5 |
| 15 | 31.3 | 34.8 | 30.8 | 26.9 | 25.9 | 25.7 |
| 30 | 38.2 | 39.0 | 34.8 | 34.3 | 35.0 | 32.8 |
| 45 | 43.6 | 43.0 | 39.8 | 38.6 | 39.3 | 38.0 |
| 60 | 48.6 | 46.1 | 44.3 | 43.8 | 43.8 | 42.7 |
| 75 | 52.4 | 49.3 | 48.8 | 47.2 | 47.5 | 47.1 |
| 90 | 56.1 | 52.9 | 51.8 | 51.7 | 50.6 | 50.6 |
| 105 | 58.6 | 55.4 | 55.6 | 54.5 | 53.8 | 53.6 |
| 120 | 62.8 | 58.2 | 58.4 | 58.8 | 58.3 | 57.2 |

TABLE 1(B)

Example 1

| | WEIGHT RATIO - WET BALL[1]:DRY BALL | | | | | |
|---|---|---|---|---|---|---|
| TIME | CYCLE 1[2] | CYCLE 2[3] | CYCLE 3[4] | CYCLE 4[5] | CYCLE 5[6] | CYCLE 6[7] |
| 0 | 1:1 | 1:1 | 1:1 | 1:1 | 1:1 | 1:1 |
| 15 | 1.08:1 | 1.08:1 | 1.08:1 | 1.07:1 | 1.06:1 | 1.07:1 |
| 30 | 1.10:1 | 1.09:1 | 1.09:1 | 1.09:1 | 1.09:1 | 1.08:1 |
| 45 | 1.11:1 | 1.10:1 | 1.10:1 | 1.10:1 | 1.10:1 | 1.10:1 |
| 60 | 1.12:1 | 1.11:1 | 1.11:1 | 1.11:1 | 1.11:1 | 1.11:1 |
| 75 | 1.13:1 | 1.11:1 | 1.12:1 | 1.12:1 | 1.12:1 | 1.12:1 |
| 90 | 1.14:1 | 1.12:1 | 1.13:7 | 1.13:1 | 1.12:1 | 1.13:1 |
| 105 | 1.15:1 | 1.13:1 | 1.14:1 | 1.14:1 | 1.13:1 | 1.13:1 |
| 120 | 1.16:1 | 1.14:1 | 1.15:1 | 1.15:1 | 1.14:1 | 1.14:1 |

[1]Wet ball number rounded off to nearest 1/100th
[2]Based on weight of sample at time "0" of Cycle 1 = 395.9 g
[3]Based on weight of sample at time "0" of Cycle 2 = 399.4 g
[4]Based on weight of sample at time "0" of Cycle 3 = 395.7 g
[5]Based on weight of sample at time "0" of Cycle 4 = 394.4 g
[6]Based on weight of sample at time "0" of Cycle 5 = 397.0 g
[7]Based on weight of sample at time "0" of Cycle 6 = 396.4 g

TABLE 2(A)

Comparative Example 1

| | Change in Ball Weight (in grams) | | | | | |
|---|---|---|---|---|---|---|
| Time | Cycle 1 | Cycle 2 | Cycle 3 | Cycle 4 | Cycle 5 | Cycle 6 |
| 0 | 0.0 | 6.9 | 10.1 | 21.7 | 14.9 | 22.1 |
| 15 | 54.7 | 45.1 | 40.8 | 47.2 | 37.9 | 48.9 |
| 30 | 84.8 | 69.5 | 66.1 | 66.0 | 59.2 | 66.2 |
| 45 | 100.8 | 87.1 | 81.4 | 77.6 | 70.2 | 76.2 |
| 60 | 110.5 | 97.1 | 92.2 | 90.2 | 83.4 | 83.0 |
| 75 | 118.2 | 102.7 | 99.2 | 98.2 | 90.7 | 89.9 |
| 90 | 122.3 | 105.8 | 103.5 | 101.9 | 95.8 | 95.6 |
| 105 | — | — | 107.1 | 106.8 | 99.7 | 100.8 |
| 120 | — | — | 109.9 | 109.7 | 102.8 | 104.2 |

TABLE 2(B)

| | Comparative Example 1 | | | | | |
|---|---|---|---|---|---|---|
| | WEIGHT RATIO - WET BALL[1]:DRY BALL | | | | | |
| TIME | CYCLE 1[2] | CYCLE 2[3] | CYCLE 3[4] | CYCLE 4[5] | CYCLE 5[6] | CYCLE 6[7] |
| 0 | 1:1 | 1:1 | 1:1 | 1:1 | 1:1 | 1:1 |
| 15 | 1.14:1 | 1.10:1 | 1.08:1 | 1.06:1 | 1.06:1 | 1.06:1 |
| 45 | 1.25:1 | 1.20:1 | 1.18:1 | 1.13:1 | 1.13:1 | 1.13:1 |
| 60 | 1.27:1 | 1.22:1 | 1.20:1 | 1.16:1 | 1.17:1 | 1.15:1 |
| 75 | 1.29:1 | 1.24:1 | 1.22:1 | 1.18:1 | 1.18:1 | 1.16:1 |
| 90 | 1.30:1 | 1.25:1 | 1.23:1 | 1.19:1 | 1.20:1 | 1.18:1 |
| 105 | — | — | 1.24:1 | 1.20:1 | 1.21:1 | 1.20:1 |
| 120 | — | — | 1.25:1 | 1.21:1 | 1.21:1 | 1.20:1 |

[1]Wet ball number rounded off to nearest 1/100th
[2]Based on weight of sample at time "0" of Cycle 1 = 402.0 g
[3]Based on weight of sample at time "0" of Cycle 2 = 402.8 g
[4]Based on weight of sample at time "0" of Cycle 3 = 406.0 g
[5]Based on weight of sample at time "0" of Cycle 4 = 417.6 g
[6]Based on weight of sample at time "0" of Cycle 5 = 410.8 g
[7]Based on weight of sample at time "0" of Cycle 6 = 418.0 g

TABLE 3(A)

| | Comparative Example 2 | | | | | |
|---|---|---|---|---|---|---|
| | Change in Ball Weight (in grams) | | | | | |
| Time | Cycle 1 | Cycle 2 | Cycle 3 | Cycle 4 | Cycle 5 | Cycle 6 |
| 0 | 0.0 | 16.3 | 1.5 | 10.7 | 18.6 | 24.5 |
| 15 | 10.5 | 73.8 | 63.4 | 72.9 | 92.4 | 96.3 |
| 30 | 31.0 | 94.9 | 97.3 | 105.7 | 117.3 | 122.5 |
| 45 | 46.5 | 108.1 | 111.1 | 119.9 | 127.1 | 128.5 |
| 60 | 60.3 | 122.7 | 121.0 | 123.9 | 132.0 | 133.0 |
| 75 | 74.8 | 132.4 | 124.7 | 131.9 | 134.3 | 136.4 |
| 90 | 89.6 | 134.7 | 127.7 | 137.5 | 137.2 | 138.2 |
| 105 | 98.2 | — | 130.9 | 139.2 | 139.7 | 140.9 |
| 120 | 107.9 | — | 135.0 | 141.3 | 140.2 | 141.5 |

TABLE 4(A)

| | Comparative Example 3 | | | | | |
|---|---|---|---|---|---|---|
| | Change in Ball Weight (in grams) | | | | | |
| Time | Cycle 1 | Cycle 2 | Cycle 3 | Cycle 4 | Cycle 5 | Cycle 6 |
| 0 | 0.0 | 14.7 | 7.4 | 12.8 | 25.7 | 20.7 |
| 15 | 11.9 | 89.8 | 84.4 | 93.0 | 117.0 | 119.3 |
| 30 | 26.1 | 113.2 | 121.7 | 129.3 | 138.2 | 139.9 |
| 45 | 49.6 | 127.5 | 134.4 | 137.9 | 145.7 | 144.6 |
| 60 | 73.5 | 134.9 | 137.9 | 140.8 | 147.6 | 146.3 |
| 75 | 89.0 | 138.6 | 139.5 | 142.5 | 149.4 | 148.1 |
| 90 | 103.5 | 143.4 | 142.3 | 144.1 | 149.6 | 149.0 |
| 105 | 114.5 | — | 143.3 | 145.0 | 149.9 | 150.5 |
| 120 | 123.4 | — | 145.1 | 146.5 | 150.7 | 151.3 |

TABLE 3(B)

| | Comparative Example 2 | | | | | |
|---|---|---|---|---|---|---|
| | WEIGHT RATIO - WET BALL[1]:DRY BALL | | | | | |
| TIME | CYCLE 1[2] | CYCLE 2[3] | CYCLE 3[4] | CYCLE 4[5] | CYCLE 5[6] | CYCLE 6[7] |
| 0 | 1:1 | 1:1 | 1:1 | 1:1 | 1:1 | 1:1 |
| 15 | 1.03:1 | 1.13:1 | 1.15:1 | 1.14:1 | 1.17:1 | 1.16:1 |
| 30 | 1.07:1 | 1.18:1 | 1.23:1 | 1.22:1 | 1.23:1 | 1.22:1 |
| 45 | 1.11:1 | 1.21:1 | 1.26:1 | 1.25:1 | 1.25:1 | 1.23:1 |
| 60 | 1.14:1 | 1.24:1 | 1.28:1 | 1.26:1 | 1.26:1 | 1.24:1 |
| 75 | 1.18:1 | 1.27:1 | 1.29:1 | 1.28:1 | 1.26:1 | 1.25:1 |
| 90 | 1.21:1 | 1.27:1 | 1.30:1 | 1.29:1 | 1.27:1 | 1.26:1 |
| 105 | 1.23:1 | — | 1.31:1 | 1.30:1 | 1.28:1 | 1.26:1 |
| 120 | 1.26:1 | — | 1.32:1 | 1.30:1 | 1.28:1 | 1.26:1 |

[1]Wet ball number rounded off to nearest 1/100th
[2]Based on weight of sample at time "0" of Cycle 1 = 419.2 g
[3]Based on weight of sample at time "0" of Cycle 2 = 435.5 g
[4]Based on weight of sample at time "0" of Cycle 3 = 420.7 g
[5]Based on weight of sample at time "0" of Cycle 4 = 429.9 g
[6]Based on weight of sample at time "0" of Cycle 5 = 437.8 g
[7]Based on weight of sample at time "0" of Cycle 6 = 443.7 g

TABLE 4(B)

| | Comparative Example 3 | | | | | |
|---|---|---|---|---|---|---|
| | WEIGHT RATIO - WET BALL[1]:DRY BALL | | | | | |
| TIME | CYCLE 1[2] | CYCLE 2[3] | CYCLE 3[4] | CYCLE 4[5] | CYCLE 5[6] | CYCLE 6[7] |
| 0 | 1:1 | 1:1 | 1:1 | 1:1 | 1:1 | 1:1 |
| 15 | 1.03:1 | 1.18:1 | 1.19:1 | 1.19:1 | 1.21:1 | 1.23:1 |
| 30 | 1.06:1 | 1.24:1 | 1.28:1 | 1.28:1 | 1.26:1 | 1.28:1 |
| 45 | 1.12:1 | 1.27:1 | 1.31:1 | 1.30:1 | 1.28:1 | 1.29:1 |
| 60 | 1.18:1 | 1.29:1 | 1.32:1 | 1.31:1 | 1.28:1 | 1.30:1 |
| 75 | 1.22:1 | 1.30:1 | 1.32:1 | 1.31:1 | 1.29:1 | 1.30:1 |
| 90 | 1.26:1 | 1.31:1 | 1.33:1 | 1.31:1 | 1.29:1 | 1.30:1 |
| 105 | 1.28:1 | — | 1.33:1 | 1.32:1 | 1.29:1 | 1.31:1 |
| 120 | 1.31:1 | — | 1.33:1 | 1.32:1 | 1.29:1 | 1.31:1 |

[1]Wet ball number rounded off to nearest 1/100th
[2]Based on weight of sample at time "0" of Cycle 1 = 404.1 g
[3]Based on weight of sample at time "0" of Cycle 2 = 418.8 g
[4]Based on weight of sample at time "0" of Cycle 3 = 411.5 g
[5]Based on weight of sample at time "0" of Cycle 4 = 416.9 g
[6]Based on weight of sample at time "0" of Cycle 5 = 429.8 g
[7]Based on weight of sample at time "0" of Cycle 6 = 424.8 g

TABLE 5(A)

| | Comparative Example 4 | | | | | |
|---|---|---|---|---|---|---|
| | Change in Ball Weight (in grams) | | | | | |
| Time | Cycle 1 | Cycle 2 | Cycle 3 | Cycle 4 | Cycle 5 | Cycle 6 |
| 0 | 0.0 | 0.1 | 7.4 | 2.1 | 12.2 | 11.7 |
| 15 | 83.9 | 79.2 | 96.8 | 75.5 | 83.9 | 83.5 |
| 30 | 126.7 | 115.4 | 136.6 | 122.4 | 132.7 | 133.0 |
| 45 | 137.9 | 131.1 | 142.8 | 137.7 | 145.2 | 146.1 |
| 60 | 143.8 | 138.3 | 148.7 | 142.7 | 147.9 | 150.7 |
| 75 | 148.3 | 143.4 | 150.4 | 146.7 | 150.4 | 151.2 |
| 90 | 151.3 | 146.4 | 151.7 | 149.0 | 152.0 | 152.2 |
| 105 | — | 146.9 | 153.0 | 150.0 | 152.8 | 152.6 |
| 120 | — | 149.8 | 154.2 | 150.3 | 153.5 | 153.4 |

TABLE 6(A)

| | Comparative Example 5 | | | | | |
|---|---|---|---|---|---|---|
| | Change in Ball Weight (in grams) | | | | | |
| Time | Cycle 1 | Cycle 2 | Cycle 3 | Cycle 4 | Cycle 5 | Cycle 6 |
| 0 | 0.0 | 2.5 | 12.0 | 4.3 | 8.8 | 0.8 |
| 15 | 123.1 | 133.7 | 136.6 | 137.1 | 135.5 | 129.4 |
| 30 | 140.2 | 143.7 | 145.9 | 144.4 | 145.9 | 142.6 |
| 45 | 146.0 | 147.5 | 148.3 | 147.9 | 147.6 | 145.6 |
| 60 | 150.8 | 150.0 | 150.4 | 148.9 | 149.7 | 148.3 |
| 75 | 153.6 | 151.7 | 152.7 | 150.8 | 151.1 | 149.4 |
| 90 | 155.7 | 153.2 | 153.8 | 152.2 | 153.0 | 150.7 |
| 105 | 158.0 | 154.0 | 154.7 | 153.5 | 153.6 | 151.2 |
| 120 | 159.2 | 155.0 | 156.1 | 154.4 | 154.4 | 152.7 |

TABLE 5(B)

| | Comparative Example 4 | | | | | |
|---|---|---|---|---|---|---|
| | WEIGHT RATIO - WET BALL[1]:DRY BALL | | | | | |
| TIME | CYCLE 1[2] | CYCLE 2[3] | CYCLE 3[4] | CYCLE 4[5] | CYCLE 5[6] | CYCLE 6[7] |
| 0 | 1:1 | 1:1 | 1:1 | 1:1 | 1:1 | 1:1 |
| 15 | 1.21:1 | 1.20:1 | 1.22:1 | 1.18:1 | 1.17:1 | 1.17:1 |
| 30 | 1.31:1 | 1.29:1 | 1.31:1 | 1.30:1 | 1.29:1 | 1.29:1 |
| 45 | 1.34:1 | 1.32:1 | 1.33:1 | 1.33:1 | 1.32:1 | 1.32:1 |
| 60 | 1.36:1 | 1.34:1 | 1.34:1 | 1.35:1 | 1.33:1 | 1.33:1 |
| 75 | 1.37:1 | 1.35:1 | 1.35:1 | 1.36:1 | 1.33:1 | 1.34:1 |
| 90 | 1.37:1 | 1.36:1 | 1.35:1 | 1.36:1 | 1.34:1 | 1.34:1 |
| 105 | — | 1.36:1 | 1.35:1 | 1.36:1 | 1.34:1 | 1.34:1 |
| 120 | — | 1.37:1 | 1.36:1 | 1.36:1 | 1.34:1 | 1.34:1 |

[1]Wet ball number rounded off to nearest 1/100th
[2]Based on weight of sample at time "0" of Cycle 1 = 404.4 g
[3]Based on weight of sample at time "0" of Cycle 2 = 404.5 g
[4]Based on weight of sample at time "0" of Cycle 3 = 411.8 g
[5]Based on weight of sample at time "0" of Cycle 4 = 406.5 g
[6]Based on weight of sample at time "0" of Cycle 5 = 416.6 g
[7]Based on weight of sample at time "0" of Cycle 6 = 416.1 g

TABLE 6(B)

| | Comparative Example 5 | | | | | |
|---|---|---|---|---|---|---|
| | WEIGHT RATIO - WET BALL[1]:DRY BALL | | | | | |
| TIME | CYCLE 1[2] | CYCLE 2[3] | CYCLE 3[4] | CYCLE 4[5] | CYCLE 5[6] | CYCLE 6[7] |
| 0 | 1:1 | 1:1 | 1:1 | 1:1 | 1:1 | 1:1 |
| 15 | 1.32:1 | 1.33:1 | 1.31:1 | 1.34:1 | 1.32:1 | 1.33:1 |
| 30 | 1.36:1 | 1.36:1 | 1.33:1 | 1.35:1 | 1.34:1 | 1.36:1 |
| 45 | 1.37:1 | 1.37:1 | 1.34:1 | 1.36:1 | 1.35:1 | 1.37:1 |
| 60 | 1.39:1 | 1.38:1 | 1.34:1 | 1.37:1 | 1.35:1 | 1.38:1 |
| 75 | 1.39:1 | 1.38:1 | 1.35:1 | 1.37:1 | 1.36:1 | 1.38:1 |
| 90 | 1.40:1 | 1.38:1 | 1.35:1 | 1.37:1 | 1.36:1 | 1.38:1 |
| 105 | 1.40:1 | 1.39:1 | 1.35:1 | 1.38:1 | 1.36:1 | 1.38:1 |
| 120 | 1.41:1 | 1.39:1 | 1.36:1 | 1.38:1 | 1.36:1 | 1.39:1 |

[1]Wet ball number rounded off to nearest 1/100th
[2]Based on weight of sample at time "0" of Cycle 1 = 390.5 g
[3]Based on weight of sample at time "0" of Cycle 2 = 393.0 g
[4]Based on weight of sample at time "0" of Cycle 3 = 402.5 g
[5]Based on weight of sample at time "0" of Cycle 4 = 394.8 g
[6]Based on weight of sample at time "0" of Cycle 5 = 399.3 g
[7]Based on weight of sample at time "0" of Cycle 6 = 391.3 g It is apparent that the ball of the present invention performed superior to the comparative test balls and that the ball of the present invention retained its water resistance properties through repeated cycles of wetting when the other balls did not.

Figure 3:
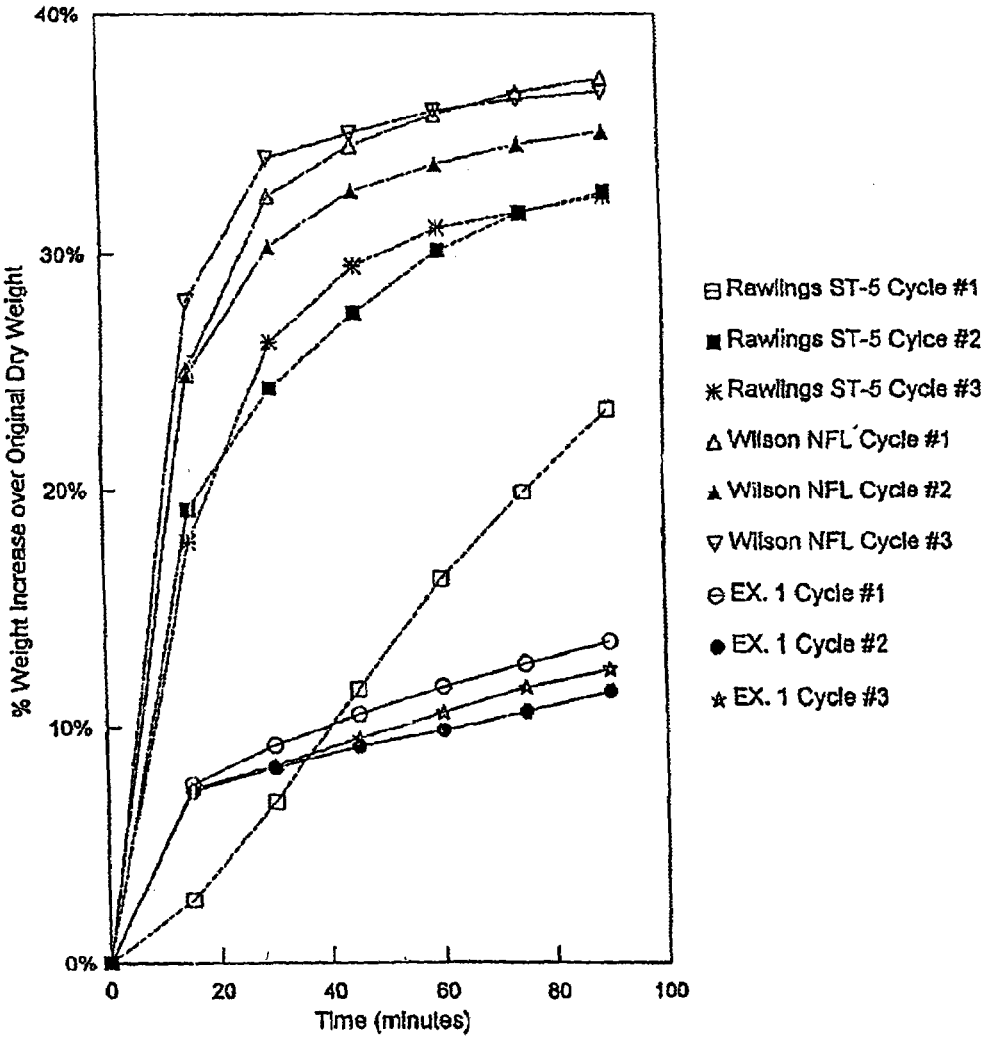
FIG. 3 is a graph showing the comparative water resistance performance in a "rain test" of commercially available footballs and a football of the present invention.

FIG. 3 presents the results of selected cycles of the rain test for comparison of the ball of the present invention with Rawlings and Wilson balls. As is apparent, the ball of the present invention provided overall superior performance compared with the other balls. Although less water was absorbed by the Rawlings ST-5 ball in the first two measurements of cycle number 1, the ball of the present invention out-performed the Rawlings ST-5 ball with longer exposure to moisture. It is interesting to note that in cycles 2 and 3, the performance of the Rawlings ST-5 ball was dramatically reduced. It appears that the water resistance properties present in the Rawlings ST-5 ball when new were considerably compromised in the initial wetting. It is speculated that the waterproofing material on the ST-5 ball was substantially washed off within the first two measurement periods of cycle number 1.

As will be apparent to persons skilled in the art, various modifications and adaptations of the structure described above will become readily apparent without departure from the spirit and scope of the invention.

What is claimed is:

1. A game ball having increased resistance to moisture absorption comprising a natural leather cover disposed over a lining, the leather of said cover having increased water resistance properties distributed throughout during a tanning process, wherein when said ball is subjected to six 45 minute cycles of a rain test and said ball is permitted to dry at approximately 70° F. for 24 hours between cycles, said ball contains an amount of water at the conclusion of each said rain test cycle as expressed as a ratio of the weight of the ball with absorbed water to the weight of the dry ball, an average per cycle ratio at the conclusion of said six rain test cycles being a maximum of 1.20:1.

* * * * *

UNITED STATES PATENT AND TRADEMARK OFFICE

CERTIFICATE OF CORRECTION

PATENT NO. : 7,066,852 B1
APPLICATION NO. : 09/248595
DATED : June 27, 2006
INVENTOR(S) : Feeney et al.

It is certified that error appears in the above-identified patent and that said Letters Patent is hereby corrected as shown below:

On Title Page, Col. 1 Item (73) should be,
-- Assignee: Russell Asset Management, Inc., Wilmington, Delaware (US) --

On Title Page, Col. 2 Item (74) should be,
-- Attorney, Agent, or Firm - Richard M. Klein of Fay, Sharpe, Fagan, Minnich & McKee, LLP --

Signed and Sealed this

Nineteenth Day of September, 2006

JON W. DUDAS
*Director of the United States Patent and Trademark Office*